US005142109A

United States Patent [19]

O'Meara, Jr. et al.

[11] Patent Number: 5,142,109

[45] Date of Patent: * Aug. 25, 1992

[54] PUNCTURE-RESISTANT MAT FOR PRESSURE-ACTUATED SWITCHES

[75] Inventors: John O'Meara, Jr., Northport; Edward W. Duhon, Setauket; Thomas Polistina, Commack; Robert E. Russell, Old Bethpage, all of N.Y.

[73] Assignee: Tapeswitch Corporation of America, Farmingdale, N.Y.

[ * ] Notice: The portion of the term of this patent subsequent to Mar. 19, 2008 has been disclaimed.

[21] Appl. No.: 581,799

[22] Filed: Sep. 13, 1990

Related U.S. Application Data

[63] Continuation of Ser. No. 343,433, Apr. 26, 1989.

[51] Int. Cl.[5] ..... H01H 3/14

[52] U.S. Cl. ..... 200/86 R; 200/5 A; 200/302.1; 200/515

[58] Field of Search ..... 340/665, 666; 307/118; 361/188; 73/146; 174/117 A; 338/114; 200/85 R, 86 R, 86.5, 81 H, 83 Z, 302.1 X, 306, 279, 294, 333, 5 A X, 512, 515 X, 517

[56] References Cited

U.S. PATENT DOCUMENTS 1,950,490 3/1934 Geer et al. .
2,938,977 5/1960 Koenig .
3,243,540 3/1966 Miller .
3,283,096 11/1966 Horton .
3,487,451 12/1969 Fontaine .
3,553,404 1/1971 Koenig .
3,715,541 6/1973 Koenig .
3,722,086 3/1983 Wikkerink et al. .
3,812,313 5/1974 Wolf et al. .
3,978,297 8/1976 Lynn et al. .
4,237,358 12/1980 Larson et al. .
4,293,752 10/1981 Koenig .
4,300,029 11/1981 Maer ..... 200/514
4,401,896 8/1983 Fowler et al. .
4,471,177 9/1984 Doughty .
4,497,989 2/1985 Miller .
4,551,595 11/1985 Koenig et al. .
4,647,738 3/1987 Diamond .
4,958,148 9/1990 Olson ..... 200/5 A

FOREIGN PATENT DOCUMENTS 787520 6/1968 Canada .

*Primary Examiner*—Gerald P. Tolin
*Attorney, Agent, or Firm*—Hoffmann & Baron

[57] ABSTRACT

A protective mat for use with pressure-actuated switching devices having a moisture-resistant, isolated switching chamber protected by a puncture-resistant, protective layer which disperses forces applied to the mat.

20 Claims, 6 Drawing Sheets

PUNCTURE-RESISTANT MAT FOR PRESSURE-ACTUATED SWITCHES

This is a continuation of copending application Ser. No. 07/343,433 filed on Mar. 26, 1989.

BACKGROUND OF THE INVENTION

The present invention is directed to switching devices, and more particularly, to a puncture-resistant mat for pressure-actuated switches.

Various types of pressure-actuated switching devices are known in the art. Switching devices have been designed for use in many different applications including the placement in passenger seats which are actuated when a person sits in the seat, placement in street surfaces which are actuated by the passage of vehicles, placement in doormats, and for security purposes, for example, to detect the movement of heavy objects such as furniture. In certain applications, it is desirable to protect the switching device by placing the switching device within a protective mat.

Electric switches have been incorporated within several types of mats in order to protect the switches from wear and other potentially adverse effects such as moisture. Included among such mat switches are those shown in U.S. Pat. Nos. 2,938,977 to Koenig, 3,243,540 to Miller, 3,283,096 to Horton (which corresponds to Canadian patent 787,520), and U.S. Pat. No. 4,497,989 to Miller.

U.S. Pat. No. 2,938,977 to Koenig discloses an electric switching mat having a bottom sheet of insulating material, a plurality of upper and lower contact strips separated by insulating strips, and an upper sheet of insulating material placed over the strips thereby sandwiching the strips between the upper and lower sheets.

U.S. Pat. No. 3,243,540, to Miller discloses an electric mat switch incorporating compressible protective layers made of foam rubber or the like.

U.S. Pat. No. 3,283,096, to Horton discloses a mat switch having a single sealed envelope for the switch element. The membranes of the switch element are themselves relatively thick members made from glass fiber-reinforced synthetic polymer in order to prevent buckling and shorting of the contact elements.

U.S. Pat. No. 3,722,086 to Wikkerink, et al. discloses a process for making floor mat switches made of two contact plates formed of sheets of slight guage spring steel which are spaced apart by a plurality of dielectric pads. Additionally, a band of dielectric material is positioned between the peripheral edges of the contact plates.

U.S. Pat. No. 4,497,989, to Miller discloses an electric mat switch wherein two conductor layers are separated by a separator layer of PVC foam. The electric mat switch also comprises a top outer layer and a separate moisture layer formed of PVC, an upper bulking layer formed of fiberglass fabric, all of which are disposed above the conductor layers. Below the conductor layers are a corresponding lower bulking layer formed of fiberglass fabric, a lower moisture layer, and a lower outer layer.

Other types of protective mats which are used with pressure sensitive electrical-switches have been used in the art, wherein layers of sheetmetal having a thickness of about 1/16 inch form the contacts of the electrical switches, and the switches are enclosed in a moisture resistant envelope. These switches, however, suffer from several disadvantages. First, these known mats do not provide protected isolation chambers for the switches. Thus, if a sharp object comes in contact with the outer surface of the protective mat and punctures the outer envelope, moisture, dirt or other corrosive substances can easily come in contact with the switching element. Secondly, since the known mats use metal plates as the switch contacts, they are not very resistant to permanent deformation. Therefore when an object comes in contact with the mat, the sheetmetal contacts are often permanently deformed and, even after the object has been removed from the mat, the permanently deformed contacts are in a position of continuous actuation rendering the switching device useless. Furthermore, the weight of the metal plates may cause design problems when it is desired to construct a very sensitive switch. Lastly, the rigidity of the metal plates combined with the tension of the outer casing, actuates the switches if the mats are not positioned on level surfaces. Thus, the floor area or other mounting surface may need special preparation during the installation of one of these known protective mats.

The above-mentioned mats are intended for use with pressure-actuated electrical switches. Such electrical switches are well-known in the art, and have been designed for many applications. Included among the switches designed for use in passenger seats are U.S. Pat. Nos. 3,487,451 to Fontaine, 3,715,541 to Koenig, and 3,812,313 to Wolf, et al.

U.S. Pat. No. 3,487,451, to Fontaine discloses a brake controlling mechanism for placement within the seat of a vehicle having a multi-layer switch element incorporating protective layers which are made of foam rubber or the like. The entire switch assembly is sealed within an outer envelope having a multiplicity of apertures which allow the envelope to breath.

U.S. Pat. No. 3,715,541, to Koenig discloses a ribbon switch having an inner sealed switch member placed between relatively stiff cover strips which transmit flexural forces to the switch.

U.S. Pat. No. 3,812,313, to Wolf, et al., discloses an electric ribbon switch designed to maintain uniform sensitivity when the switch is in a bowed condition, e.g. in the seat of a car. The Wolf, et al. switch has two contact strips: one strip has diagonal slots to enhance flexibility and the other contact strip has corresponding portusions to increase sensitivity. In order to further increase sensitivity, the contact strips are placed in a casing having a longitudinal bead. A thin spring steel actuating strap is placed adjacent the bead in order to localize and concentrate the actuating pressure applied to the outer cover.

A switch of the type designed to detect street traffic is disclosed in U.S. Pat. No. 1,950,490, to Geer, et al., which shows a membrane switch encapsulated in several layers of material and installed in a structure provided with a protective elastomeric treadle member.

Switches which may be used in doorways are disclosed in U.S. Pat. Nos. 4,293,752 to Koenig and 4,551,595 to Koenig, et al.

U.S. Pat. No. 4,293,752 to Koenig discloses a self-adhering tapeswitch comprising a conventional pair of electrical contacts separated by a pair of insulating strips, all of which are enclosed within a plastic cover. A layer of deformable material is bonded to the underside of the plastic cover. A strip of pressure sensitive adhesive is mounted on the underside of the deformable material and the adhesive is covered by a removable paper strip The paper strip is removed when it is desired to contact the adhesive with a surface.

U.S. Pat. No. 4,551,595 to Koenig, et al., discloses an electrical switch having a corrugated wavy conductor comprising an upper insulating cover strip to which is bonded a corrugated conductor strip. A corresponding bottom cover strip has a generally flat conductive strip. A pair of insulating spacer strips are mounted between the cover strips.

An example of a normally-closed pressure switch is shown in U.S. Pat. No. 3,553,404 to Koenig which discloses a ribbon switch wherein elongated, transversely curved spring-type conductive members are confined between stiffener plates and the assembly is enclosed in a sealed flexible casing.

A switch designed particularly for isolation from the environment is shown in U.S. Pat. No. 4,237,358, to Larson, et al., which discloses a membrane switch having two spaced membranes provided with facing conductive elements. The switch is provided with a "pressure reduction membrane" positioned in contact with the upper switch membrane and an additional isolation membrane superimposed on the pressure reduction membrane.

Protective mats for pressure-sensitive switches such as those described above have been useful, however, they fail to provide the degree of resistance to damage by impact and puncture by sharp objects which is desired in certain applications such as when the switch is to be used near sharp heavy objects or tools which are likely to fall on the mat.

BRIEF DESCRIPTION OF THE INVENTION

The present invention provides a puncture-resistant mat for pressure-sensitive switching devices wherein the switching elements are isolated from both the environment and the puncture-resistant member. The puncture-resistant mat of the present invention comprises an upper moisture-resistant layer, a puncture-resistant and deformation-resistant protective layer disposed below the top layer, a bladder disposed below the impact resistant layer and preferably attached to the upper layer so that the protective layer is isolated from the environment, a switching chamber defined by the lower surface of the bladder and a lower outer surface. In accordance with the present invention, the switching element is protected from harmful matter such as moisture, dirt, or corrosive chemicals which may be present in the work area near the protective mat even if the mat is subject to a blow from a sharp object which punctures the top outer layer.

DETAILED DESCRIPTION

Figure 1:
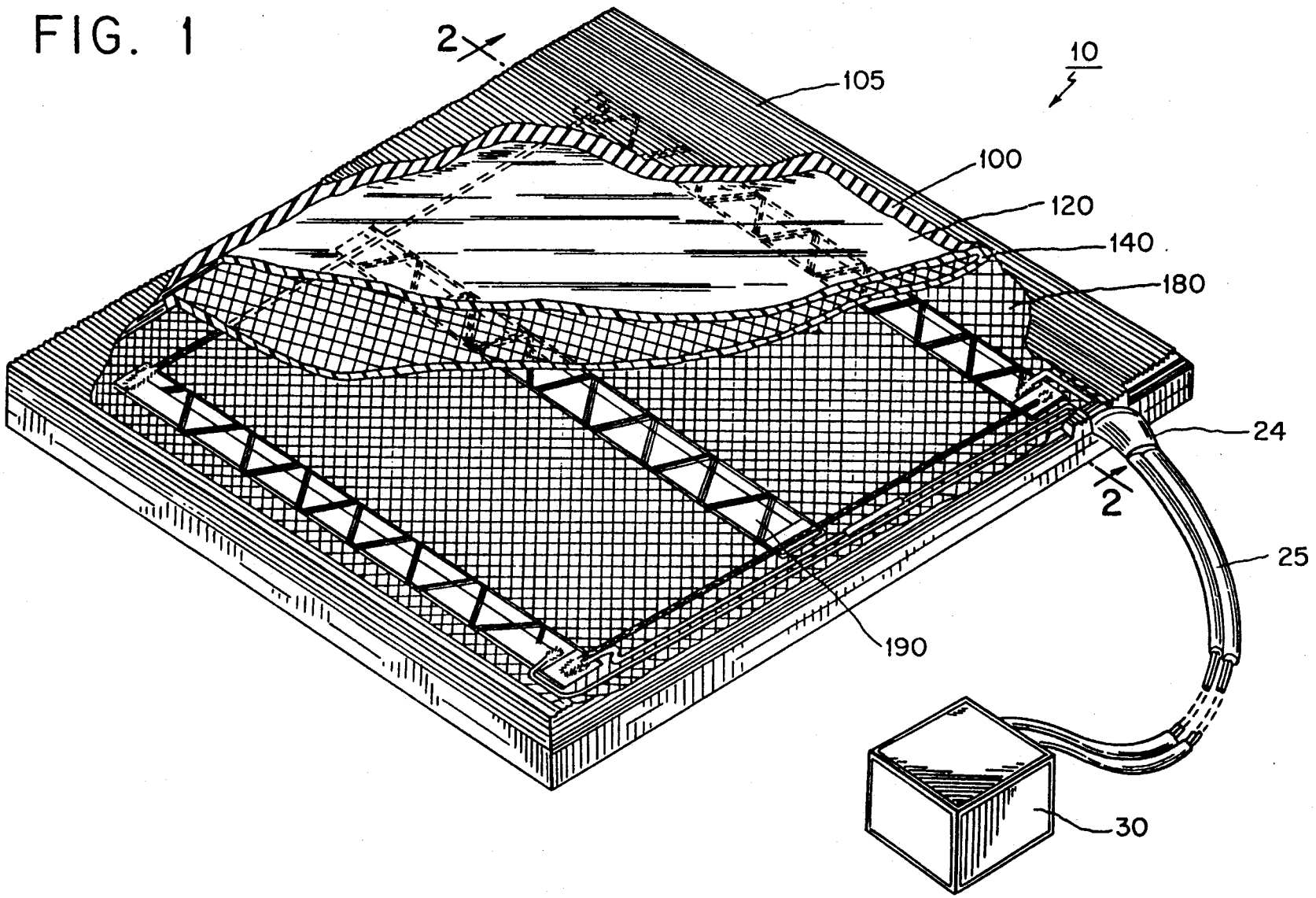
FIG. 1 is a perspective view of one embodiment of the present invention with sections removed.

With reference to FIG. 1, one embodiment of the present invention comprises a protective, puncture-resistant mat 10 for use with conventional, pressure-actuated switching elements. While other configurations are possible, it is typically most desirable to construct protective mat 10 in a generally flat configuration having a neck 24 providing communication between a switching chamber 160 and a signal receiver 30.

Figure 2:
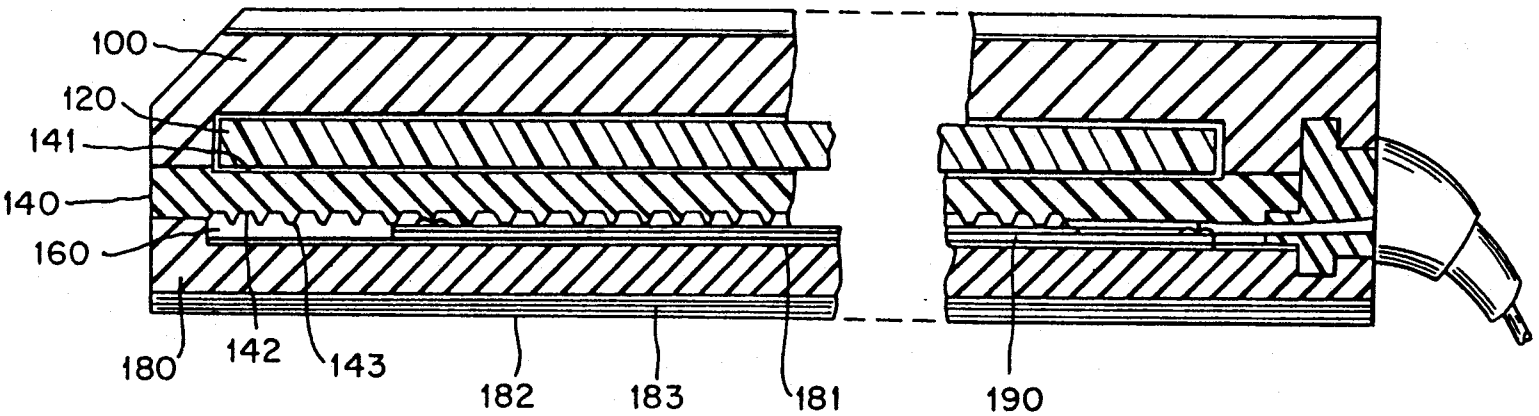
FIG. 2 is a cross sectional view taken along line 2—2 of FIG. 1.

The embodiment of the present invention shown in FIGS. 1 and 2 comprises a top layer 100, preferably formed of a wear-resistant material, e.g. rubber elastomer. Top layer 100 is also preferably moisture-resistant and impermeable to dirt, or other materials which may adversely affect the operation in switching chamber 160. Top layer 100, as well as all other layers utilized in protective mat 10, have at least a slight degree of flexibility which will allow the entire protective mat 10 to conform to floors or other mounting areas which are not perfectly flat. For example, it is preferable that the materials utilized in a protective mat 10 having dimensions of 4 ft.×4 ft.×1 k×1 inch allow the mat to be readily flexed at least about 5°. and preferably at least about 20° without adversely affecting the operation of the mat, where the angle is defined as the angle between a flat floor on which one end the mat is placed and a tangent drawn along the opposing bottom surface of the mat. Of course, it will be appreciated by those skilled in the art that the angle of flexibility will depend, in part, upon the dimensions of the mat. Additionally, protective mat 10 is advantageously sufficiently flexible so that protective mat 10 can be placed over objects in the work area, such as a heavy utility electrical cord, without causing continuous actuation of the switches. Top layer 100 is formed of any material which will withstand the environment in which the protective mat 10 will be used. For example, it will be appreciated by those skilled in the art that certain materials will have greater resistance to corrosion by specific chemicals than other materials which might otherwise be suitable.

One suitable material for top layer 100 is KOROSEAL manufactured by the Koroseal and Rubber Matting Products Company of Akron, Ohio, a division of R.J.F. International Corp. This particular elastomer has been found to have a high resistance to wear, puncture and cutting. Koroseal is also relatively easy to work with and seal along its edges using sealing methods known in the art, for example, heat sealing.

As shown in FIG. 1, top layer 100 may also comprise ribs 105 in order to provide skid resistance for people stepping on the mat. Ribs 105 also enhance the drainage of liquids which may fall onto the mat and thereby increase the overall life of the mat. While the thickness of top layer 100 may vary for the particular applications in which protective mat 10 will be used, it has been found that the preferred thickness of upper layer 100 is at least about 1/16 inch and is more preferably about 3/16 inch including the top ribs.

Disposed below top layer 100 is a puncture-resistant, deformation-resistant protective layer 120 which disperses forces applied to the mat, especially high, point-of-impact forces applied by sharp tools or the like, over relatively wide areas in order to protect the portion of mat 10 disposed below protective layer 120 from puncture. As used herein, the term "deformation" is used to mean permanent deformation, i.e., a change in the shape of an object upon the application of a force wherein the object does not return to the configuration it had before the application of the force. As mentioned above, protective layer 120 has sufficient flexibility to enable bending of the entire protective mat 10 when the mat is not placed on a perfectly level surface. Protective layer 120 must have a sufficient degree of flexibility so that if protective mat 10 is placed on an uneven surface or a surface containing a ridge, for example, a concrete floor having a heavy electrical cord which runs under mat 10, protective layer 120 permits the entire mat 10 to bend without continuously actuating the pressure-actuated element. Protective layer 120 must also have sufficient resistance to permanent deformation such that if an object is dropped on protective mat 10, though the object may puncture top layer 100 and instantaneously deform protective layer 120, protective layer 120 will not stay in such deformed position so as to continuously actuate a pressure-actuated switching element.

One method of measuring the suitability of a material or combination of materials for use as protective layer 120 is to measure the distance that a dent or groove will protrude from the bottom surface of protective layer 120 after the application of an impact by a dart weighing about 2½ pounds, with a point having a diameter of about 0.10 inches which is dropped from a still position approximately 8 feet above the mat. In order to be considered "deformation-resistant" in accordance with the present invention, the permanent deformation of a protective layer having a thickness of about ¼ inch subject to the preceding "Dart Test" will preferably not exceed about 0.050 inches and is most preferably less than about 0.025 inches.

As used herein, the term "puncture resistant" means that the protective layer will not be punctured i.e. such that a hole passes entirely through the protective layer, when the layer is subjected to the "Dart Test" referenced above but modified such that the dart is dropped from a height of about 3 feet. It will be appreciated by those skilled in the art that light guage metals, such as 1/16 inch thick spring steel, are not "puncture-resistant" as that term is used herein.

While not necessary to the practice of the present invention, as shown in FIG. 1, protective layer 120 may be advantageously sealed between top layer 100 and a bladder layer 140.

The material or combination of materials used in the construction of protective layer 120 are designed to disperse a blow of a sharp object which may come in contact with protective mat 10. Protective layer 120 may be formed of a single material such as layers of a high impact-resistant polycarbonate e.g. LEXAN/-LEXGUARD™ made by General Electric, or may be formed from layers of different materials such as a high-impact resistant polycarbonate with a middle-layer of re-enforcing material such as Kevlar.

In order to spread the force of an impact over as wide an area as possible, it is preferable to have the bottom or non-impact side of protective layer 120 to be generally smooth.

Disposed below protective layer 120 is a hermetically-sealed switching chamber 160, shown in FIG. 2, defined by flexible, moisture-resistant bladder layer 140 and flexible, moisture-resistant bottom layer 180. The only opening to switching chamber 160 is provided by reinforced neck 24 which allows communication between switching chamber 160 and signal receiver 30.

The top 141 of bladder layer 140 is preferably substantially smooth in order to receive an impact from protective layer 120 over as wide of an area as possible. The bottom surface 142 of protective layer 140 preferably comprises a number of ribs 143 which extend substantially from one end of switching chamber 160 to the other end. The advantages provided by ribs 143 will be described below.

Bottom layer 180 has a top surface 181 and a bottom surface 182. As shown in FIG. 2, bottom surface 182 of bottom layer 180 is advantageously provided with ribs 183 which will allow water and other fluids to drain below protective mat 10. Therefore, if protective mat 10 is intended for use in an area subject to liquid spills, protective mat 10 will not impede the drainage of the spilled liquid into an already existing drain nor will it cause fluids which might shorten the useful life of protective mat 10 to collect next to protective mat 10.

Figure 4:
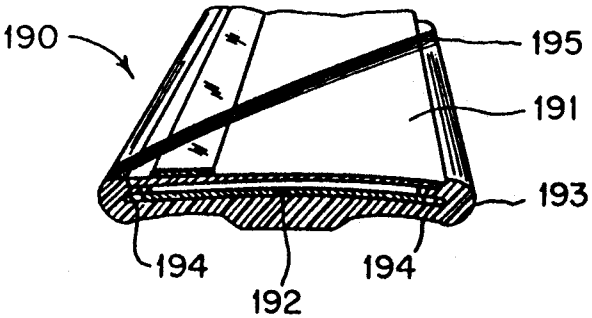
FIG. 4, is a cross sectional view of the electrical switch shown in FIG. 3 along line 4—4.
Figure 3:
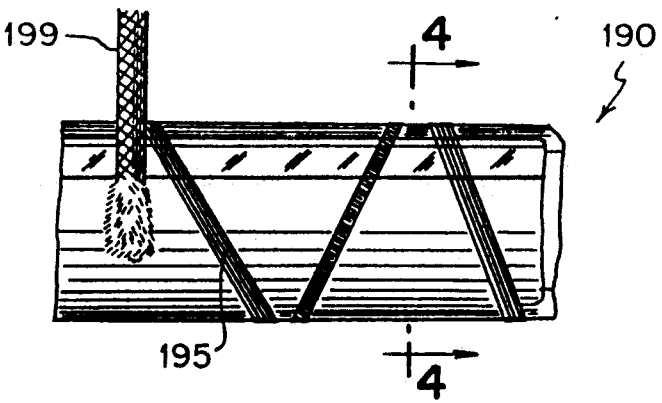
FIG. 3 is a top view of an electrical switch which may be used in one embodiment of the present invention.

In the embodiment illustrated in FIGS. 1–4, the protective mat 10 of the present invention comprises a plurality of pressure-actuated electrical switches. The particular type of electrical pressure-actuated switches which are employed may vary for different applications. One type of electrical pressure-actuated switch which is suitable for many industrial applications is shown in FIGS. 1–4 wherein electrical pressure-actuated switch 190 comprises electrical contacts 191 and 192 separated by insulating material 193. In order to facilitate construction, insulating material may be formed in the shape of a strip having grooves 194 at either end as shown in FIG. 4. In this manner, one contact strip 192 may be disposed below the insulating grooves 194 while the other contact strip 191 may be disposed above the insulating groove 194. A non-conductive filament 195 is preferably wrapped around the electrical pressure-actuated switch 190 in order to hold the elements of the switch 190 together. Switches 190 may be connected in parallel, as shown in FIG. 1, or in series via electrically conductive wires 199. As shown in FIG. 1, pressure-actuated electrical switches 190 are connected to signal receiver 30 via protected conduits 25 which pass through protective reinforced neck 24. It will be appreciated by those skilled in the art that other types of pressure-actuated electrical switches may be utilized without departing from the scope of the present invention. The spacing of the electrical, pressure-actuated switches may vary depending upon the specific application to which the protective mat will be used. A spacing of about 1½ to about 5 inches from the center of one electrical switch to another is acceptable for many industrial applications.

It will also be appreciated that, in accordance with the present invention, switching chamber 160 may be divided into a number of switching zones for several reasons. In certain applications, it may be desirable to have one portion of the switching element providing a signal to one control device while another portion of the switching chamber actuates another device. In such instances, it may also be desirable to provide a corresponding plurality of protective layers (not shown) which each extend over only a portion of bladder 140, instead of a single protective layer 120 as shown in FIG. 1. As an alternative, several isolated switching chambers can be provided.

In accordance with the embodiment of the present invention disclosed in FIGS. 1–4 wherein the pressure-actuated device comprises a plurality of electrical pressure-actuated switches 190, the switches 190 are preferably arranged perpendicular to the ribs 143 of bladder layer 140. In this manner, the force applied by each rib 143 at the point of contact between rib 143 and pressure-actuated electrical switch 190 is more concentrated than if the ribs 143 extended parallel to switches 190. It will be appreciated by those skilled in the art, that the actuation of switches 190 only requires contact at a single point along the top or bottom of the switches 190, as opposed to a complete contact along the entire length of the switch 190.

Figure 5:
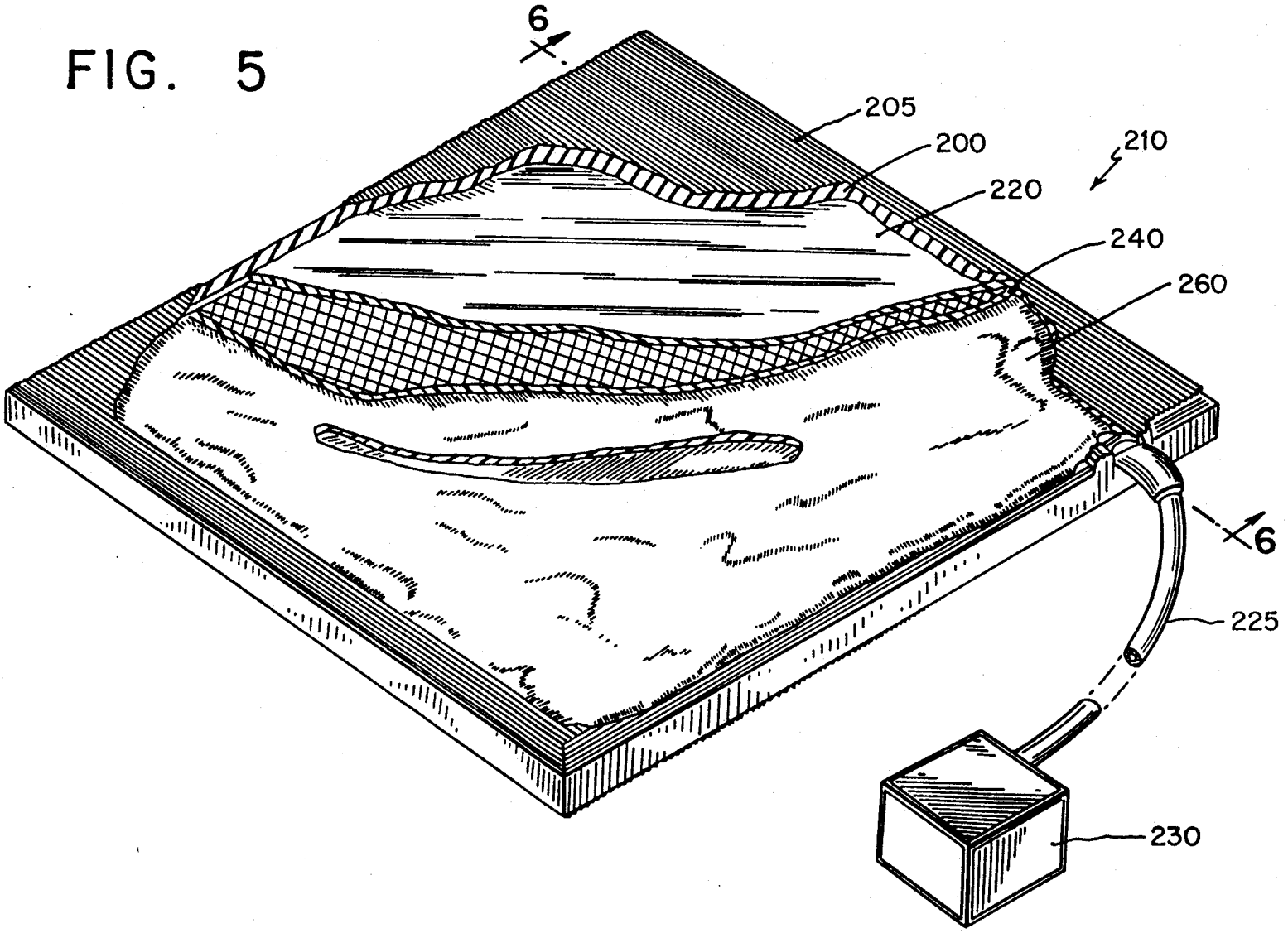
FIG. 5 is a perspective view of another embodiment of the present invention with sections removed wherein a pneumatic pressure-sensing switch is utilized.
Figure 6:
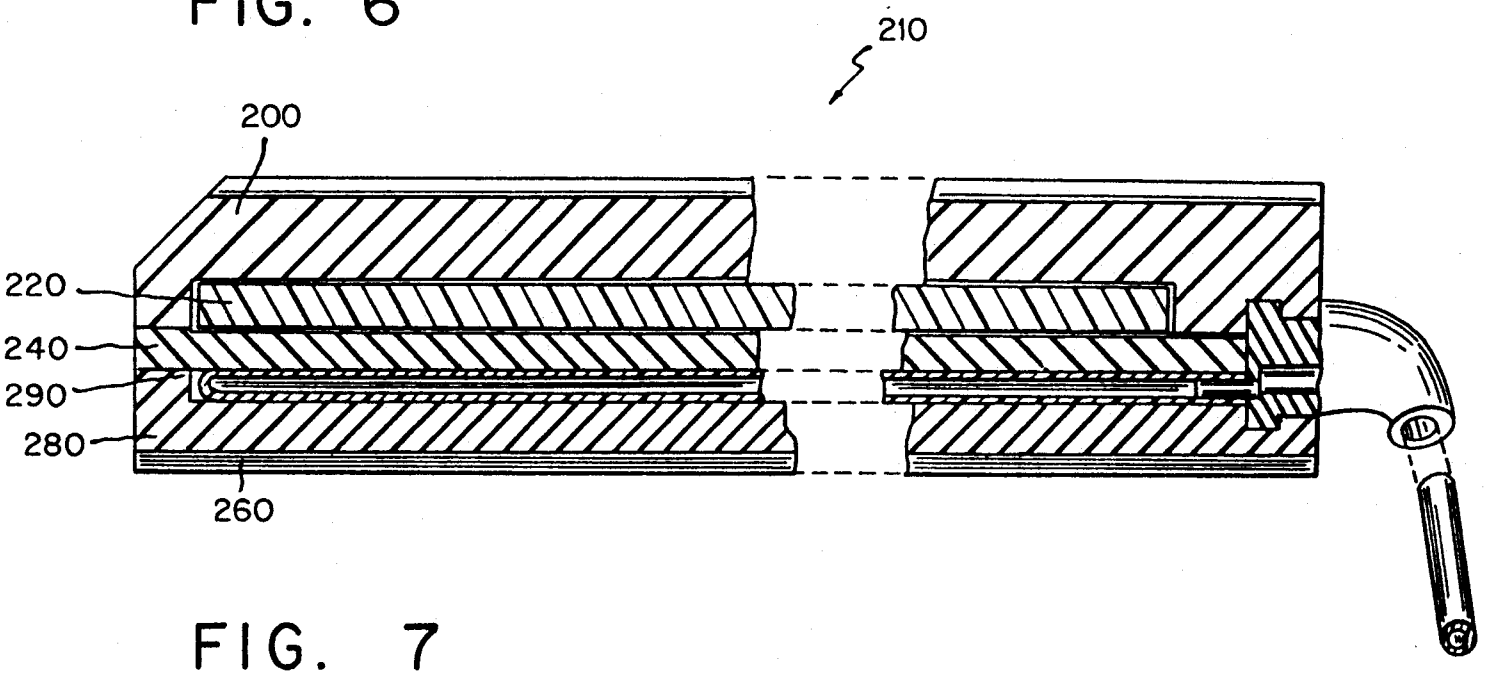
FIG. 6 is a cross sectional view taken along line 6—6 of FIG. 5.
Figure 7:
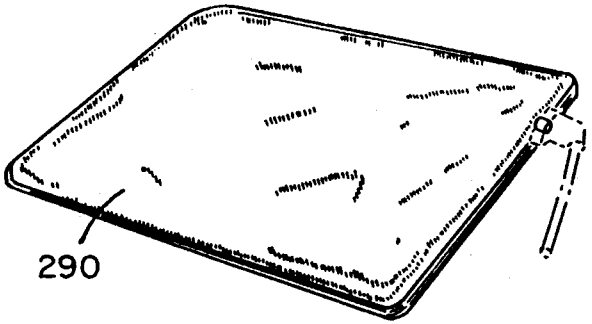
FIG. 7 is a perspective view of a pneumatic chamber which may be used with the embodiment of the present invention shown in FIG. 5.

In accordance with an alternative embodiment of the present invention illustrated in FIGS. 5–8, the protective mat 210 of the present invention utilizes a pneumatically-operated switch. In this embodiment, switching chamber 260 is an air tight, sealed chamber which is connected to a pneumatically-operated switch 230 by a hollow conduit 225. Such pneumatically-operated switches are known in the art whereby a surge of air or other fluid pressure is sensed by pneumatic switching device 230 and is converted to an electrical signal. This embodiment is similar to the embodiment illustrated in FIGS. 1–4 wherein a top protective layer 200 preferably comprises ribs 205, and a protective layer 220 shields a bladder layer 240 from sharp blows. Switching chamber 260 is defined by bladder layer 240 and bottom layer 280. If desired for added protection, a hollow, air-tight vessel 290 as shown in FIGS. 6 and 7 may be disposed between bladder layer 240 and bottom layer 280. However, since the seal between bladder 240 and bottom layer 280 is both water and air tight, an additional resiliant, hollow vessel 290 is not necessary in order to practice this embodiment of the present invention.

Figure 8:
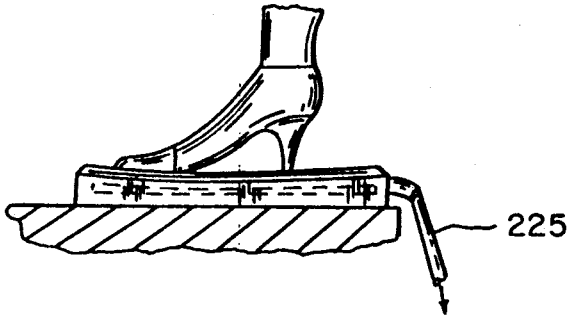
FIG. 8 is a side view of the embodiment shown in FIG. 5 illustrating the operation of this embodiment.

FIG. 8 illustrates the operation of this embodiment of the present invention wherein, upon the application of a force to protective mat 210, air or any other suitable fluid is forced from pneumatic switching-chamber 260 out through hollow conduit 225 in order to actuate pneumatically-operated switch 230.

As shown in FIGS. 5 and 6, protective mat 210 is similar to protective mat 10 in most respects with the exception of the type of pressure-actuated switching element which is utilized. As shown in FIGS. 5 and 6, protective mat 210 comprises a top layer 200, a protective layer 220, a bladder layer 240, a switching chamber 260, and a bottom layer 280.

Figure 9:
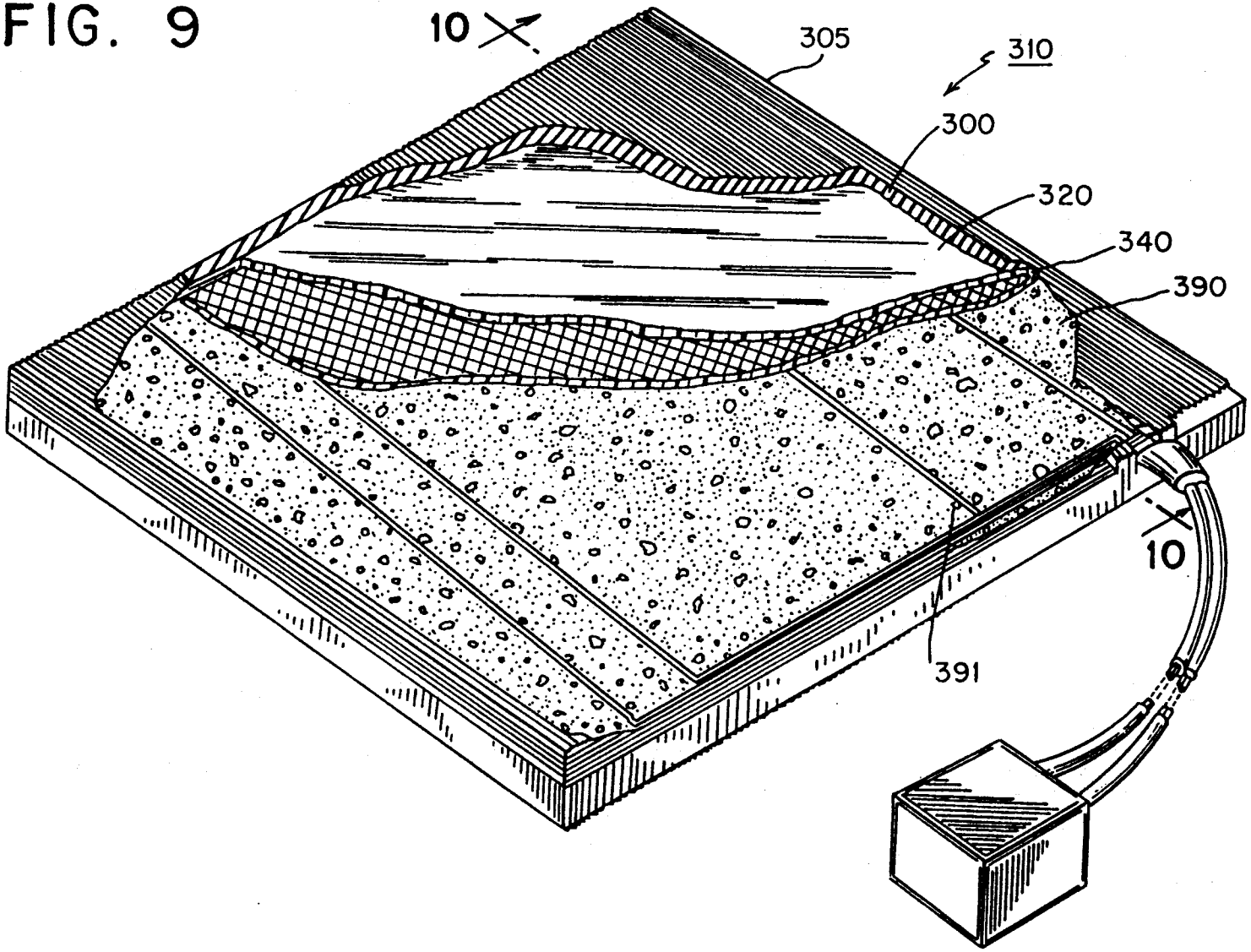
FIG. 9 is a perspective view with sections removed of still another embodiment of the present invention wherein the switching element comprises electrical contacts separated by carbon impregnated elastomer.
Figure 10:
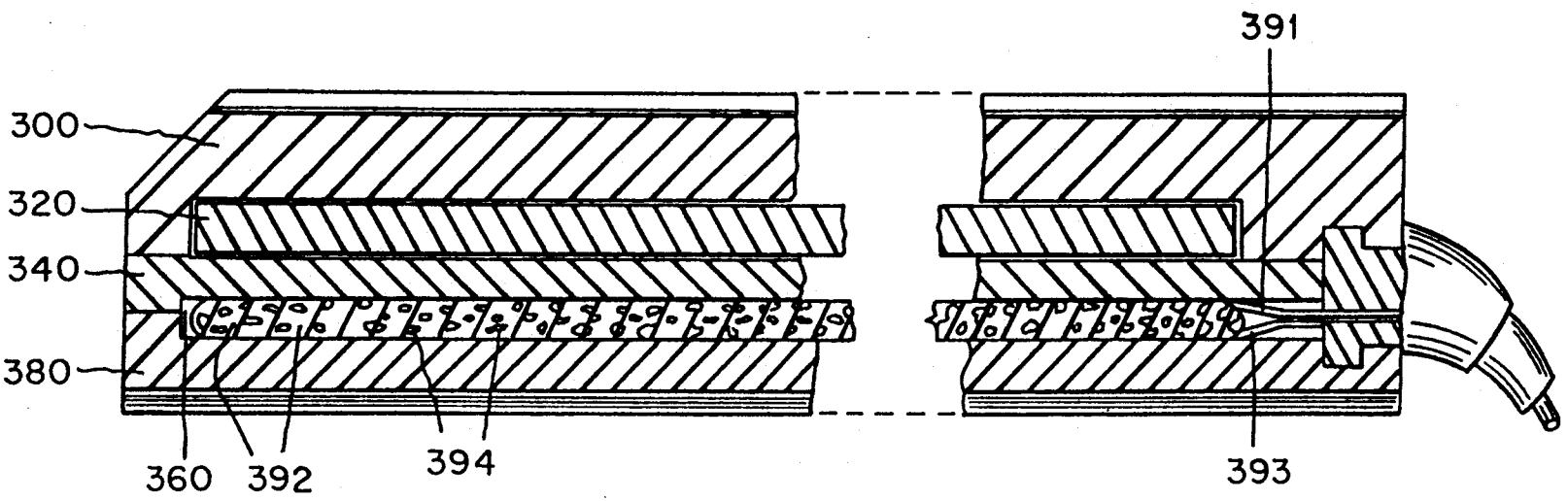
FIG. 10 is a cross sectional view taken along lines 10—10 of FIG. 9.

In still another embodiment of the present invention shown in FIGS. 9 and 10, protective mat 310 comprises a top cover 300 having ribs 305, a protective layer 320, a bladder layer 340, a switching chamber 360, and a bottom layer 380. The signal generating means 390 of protective mat 300, comprises a carbon impregnated elastomer 392 disposed between electrical contact strips 391 and 393. As generally illustrated in FIG. 9, upper contacts 391 are disposed above the impregnated elastomer 392 while lower contacts 393 (not shown) are disposed below impregnated elastomer 392. The elastomer 392 is impregnated with a large number of relatively small electrically conductive particles 394, for example, particles of about 0.030 inches in diameter present in the amount of about 15% by volume. The conductive particles 394 are dispersed in the elastomer 392 in a quantity which is insufficient to provide electrical contact between the top contact 391 and the bottom contact 393 when the elastomer layer 390 is in a relaxed, expanded configuration, however, when the elastomer is compressed, the particles 394 contact each other and provide an electrical path connecting the top contact 391 to the bottom contact 393. In this matter, a pressure-actuated signal generating device 390 is provided within switching chamber 360.

While the protective mat of the present invention has been described as having a protective layer disposed above the pressure-actuated means, it will be appreciated by those skilled in the art that for certain applications it may be desirable to invert the protective mat of the present invention such that the protective layer is disposed below the switching chamber formed between the bladder layer and the outer cover, or to provide impact and penetration protection to the top and bottom of the switching chamber by providing a protective layer above and below the switching chamber.

As shown in the cross sectional views of FIGS. 2, 6 and 10, the top, bladder, and bottom layers may be provided with cut-out portions in order to facilitate the placement of the protective layers and the pressure-sensing means. The illustrated cut-out portions are not necessary and the protective mats of the present invention can be formed using top, bladder, and bottom layers which have substantially flat surfaces which simply extend over the edges of the protective layer and the pressure sensing device a sufficient distance, for example about 1½ inches, in order to provide room for the sealing of these layers. The actual method used to seal the layers will depend upon the materials used for the top layer, bladder layer, and bottom layer. However, when polyurethane or polyvinyl chloride materials are used to form each of these layers, a heat sealing of the layers using R-F energy is suitable and provides durable seals which are generally easy to work with.

We claim:

1. A protective mat comprising:

a fluid-tight first chamber; having at least a top wall and a bottom wall;

a fluid-tight second chamber having a top layer and a bottom layer, said second chamber disposed proximate said first chamber and having a common wall therewith;

a flexible, protective layer disposed within said first chamber;

a pressure-actuated device disposed outside said first and second chambers which generates a signal in response to a force applied to said second chamber; and a conduit connecting said second chamber with said pressure-actuated device, and wherein said protective layer is puncture-resistant such that said protective layer is not punctured upon impact by a dart weighing about 2¼ pounds, with a point having a diameter of about 0.10 inches dropped from a still position approximately 3 feet above said protective layer.

2. A protective mat according to claim 1 wherein said top wall comprises a rubber elastomer.

3. A protective mat according to claim 1 wherein said bottom wall and said top layer are defined by a single bladder layer comprising a rubber elastomer.

4. A protective mat according to claim 1 wherein said bottom layer comprises a rubber elastomer.

5. A protective mat according to claim 1 wherein said protective layer comprises a bottom surface and a top surface, and said protective layer is deformation-resistant such that said bottom surface does not receive a dent exceeding about 0.05 inches upon impact of a dart weighing bout 2¼ pounds, with a point having a diameter of about 0.10 inches which is dropped from a still position approximately 8 feet above said top surface.

6. A protective mat according to claim 1 wherein said protective layer comprises a plurality of layers.

7. A protective mat according to claim 5 wherein said bottom surface does not receive a dent exceeding about 0.025 inches.

8. A protective mat according to claim 1 wherein said protective layer comprises a plurality of layers.

9. A protective mat according to claim 1 wherein said pressure-actuated device comprises a pneumatically-operated switch.

10. A protective mat according to claim 1 wherein a carbon impregnated elastomer is disposed within said second chamber.

11. A protective mat comprising:

a fluid-tight switching chamber having at least a top wall and a bottom wall;

a pressure-actuated switching device disposed at least partially within said switching chamber;

a protective layer disposed proximate said switching chamber, and covering and protecting at least a portion of said pressure-actuated switching device from impact, wherein said protective layer is puncture-resistant such that said protective layer is not punctured upon impact by a dart weighing about 2¼ pounds, with a point having a diameter of about 0.10 inches dropped from a still position approximately 3 feet above said protective layer.

12. A protective mat according to claim 11 further comprising a wear-resistant top layer comprising a rubber elastomer disposed above said protective layer.

13. A protective mat according to claim 11 wherein said top wall comprises a rubber elastomer.

14. A protective mat according to claim 11 wherein said bottom wall comprises a rubber elastomer.

15. A protective mat according to claim 11 wherein said protective layer comprises a bottom surface and a top surface, and said protective layer is deformation-resistant such that said bottom surface does not receive a dent exceeding about 0.05 inches upon impact of a dart weighing about 2¼ pounds, with a point having a diameter of about 0.10 inches which is dropped from a still position approximately 8 feet above said top surface.

16. A protective mat according to claim 11 wherein said protective layer comprises a plurality of layers.

17. A protective mat according to claim 15 wherein said bottom surface does not receive a dent exceeding about 0.025 inches.

18. A protective mat according to claim 11 wherein said pressure-actuated switching device comprises at least one electrical switch.

19. A protective mat according to claim 11 wherein said pressure-actuated switching device comprises a carbon-impregnated elastomer.

20. A protective mat according to claim 11 wherein said protective layer comprises a plurality of layers.

* * * * *